United States Patent [19]

Araoka

[11] Patent Number: 4,728,256

[45] Date of Patent: Mar. 1, 1988

[54] UNDERWATER PUMP

[76] Inventor: Toshinobu Araoka, 7-10, Norimatsu 1-chome, Yahatanishi-ku, Kitakyushu-shi, Fukuoka, Japan

[21] Appl. No.: 53,592

[22] Filed: May 20, 1987

Related U.S. Application Data

[63] Continuation of Ser. No. 847,791, Apr. 3, 1986, abandoned.

[30] Foreign Application Priority Data

Jul. 26, 1985 [JP] Japan ..... 60-166335

[51] Int. Cl.[4] ..... F04D 29/70

[52] U.S. Cl. ..... 415/121 G

[58] Field of Search ..... 415/121 G, 121 R, 143; 366/263

[56] References Cited

U.S. PATENT DOCUMENTS

| | | | |
|---|---|---|---|
| 2,963,979 | 12/1960 | Eisenmann et al. | 415/121 G |
| 3,465,523 | 9/1969 | Clark, Jr. | 415/183 |
| 3,593,345 | 7/1971 | Wells | 415/183 |
| 4,456,424 | 6/1984 | Araoka | 415/143 |

FOREIGN PATENT DOCUMENTS

| | | | |
|---|---|---|---|
| 1217268 | 5/1960 | France | 415/121 G |
| 70992 | 5/1982 | Japan | 415/121 G |
| 58-50531 | 11/1983 | Japan . | |
| 1024890 | 4/1966 | United Kingdom | 415/121 G |
| 881367 | 11/1981 | U.S.S.R. | 415/53 R |

*Primary Examiner*—Robert E. Garrett
*Assistant Examiner*—John T. Kwon
*Attorney, Agent, or Firm*—Jordan and Hamburg

[57] ABSTRACT

The present invention relates to an underwater pump which is characterized by mounting a stationary flexible-piece-winding preventing member, such as a stationary sleeve, on an outer periphery of a portion of a rotating shaft of a rotary motor where a rotating head such as an agitator is mounted. Due to such construction, the winding or adhesion of a flexible piece to the rotary-head mounting portion can be effectively prevented.

13 Claims, 12 Drawing Figures

UNDERWATER PUMP

This application is a continuation of application Ser. No. 847,791, filed Apr. 3, 1986, now abandoned.

TECHNICAL FIELD

The present invention discloses an underwater pump for excavating or sucking sands or gravels from the bottom of the sea or the river.

BACKGROUND OF THE INVENTION

Conventionally, various kinds of underwater pumps have been developed for the above purpose including the pump which is disclosed in Japanese Patent Publication SHO58-50531.

In these pumps, however, the portion of the rotating shaft where the rotating head such as the agitator is mounted is totally exposed to the water so that any flexible pieces such as cloth or thin plastic strips contained in the sand tend to adhere to or are wound around the exposed rotating portion. These flexible pieces eventually narrow or clog the passage through which the excavated sand flows into the impeller casing so that excavating efficiency is greatly damaged. Furthermore, in an extreme case, such flexible piece may cause the stoppage of the rotation of the agitator and the malfunction of the underwater pump.

SUMMARY OF THE INVENTION

Accordingly, it is an object of the present invention to provide an under water pump which can resolve the above defects of the conventional underwater pumps and can assure the constant smooth flow of the sand even when the sand contains such flexible pieces.

It is another object of the present invention to provide an underwater pump which can be cheaply manufactured despite installation of means for preventing the adhering of flexible piece to the rotating shaft.

In summary, the present invention discloses an underwater pump which is characterized by mounting a fixed or stationary sleeve on an outer periphery of a portion of a rotating shaft of a motor where a rotating head such as an agitator is mounted.

DETAILED DESCRIPTION OF THE PREFERRED EMBODIMENTS

The present invention is disclosed in detail in conjunction with the embodiments shown in the attached drawings.

First embodiment

Figure 1:
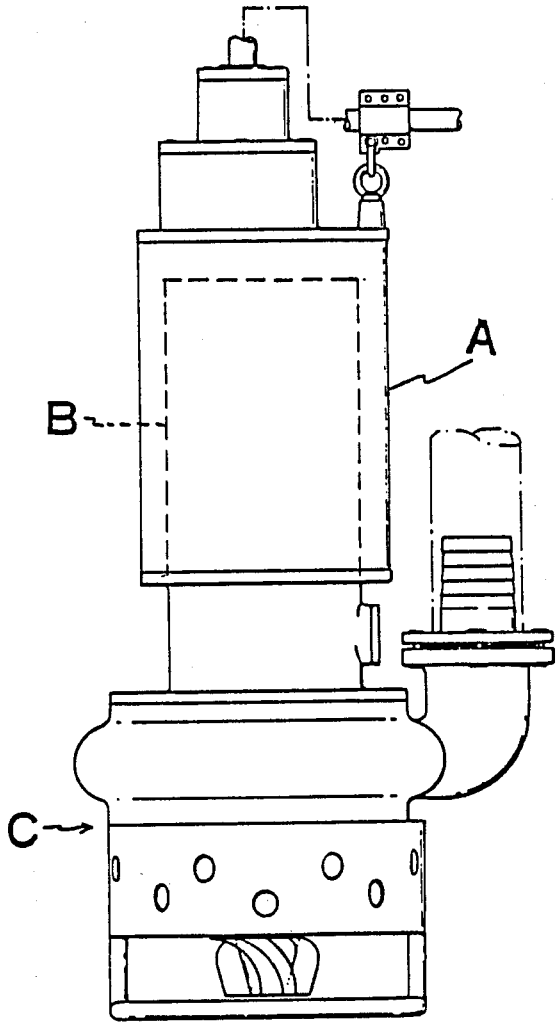
FIG. 1 is an elevational view of the underwater pump of the present invention.

In FIG. 1, the entire structure of the underwater pump of the present invention is disclosed, wherein A indicates a pump casing of a cylindrical construction which encases a rotary motor B which may be either a power-operated motor or hydraulically operated motor.

A pump portion C of a cylindrical construction is fixedly and integrally connected to the lower end of the pump casing.

Figure 2:
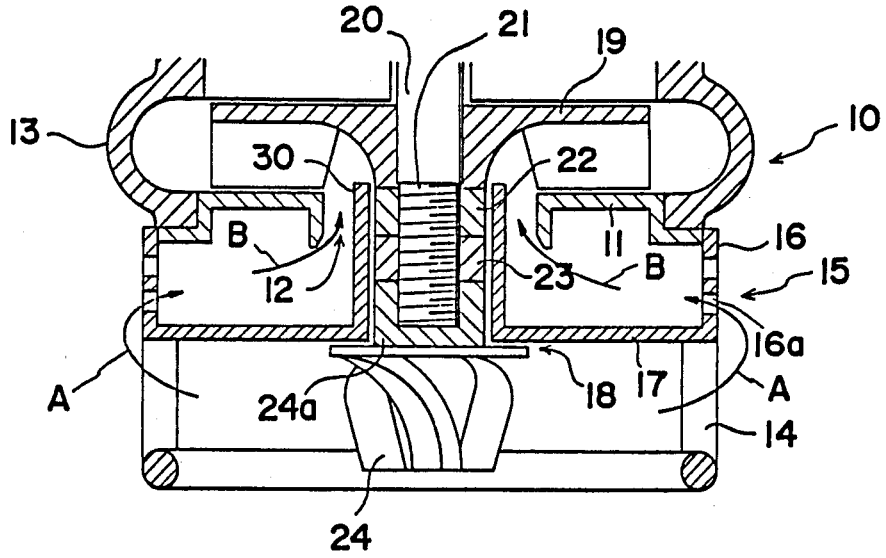
FIG. 2 is an enlarged view of a first embodiment of the above underwater pump.

In FIG. 2, the inner structue of the pump portion C of the underwater pump is shown, wherein numeral 10 indicates an impeller casing fixedly and integrally connected to the pump casing A.

Such impeller casing 10 is provided with a suction opening 12 at the central portion of the bottom wall 11 thereof, while a sand discharge opening is formed on the peripheral or circumferential wall thereof.

Numeral 15 indicates a cylindrical strainer which is disposed below the impeller casing 10. The cylindrical strainer 15 comprises an annular side wall 16 which is replaceably but firmly secured to the bottom wall 11 of the impeller casing 10 and a circular bottom plate 17 which has an outer peripheral rim thereof secured to the lower end of the annular side wall 16. The cylindrical strainer 15 is stably supported on the bottom of the sea or the water by means of a plurality of support struts 14 made of a bottom circular ring and a plurality of vertical strut members equidistantly disposed around the ring, thus defining a space between the circular bottom plate 17 of the cylindrical strainer 15 and the bottom of the sea.

A multiplicity of perforations or apertures 16*a* are formed on the annular side wall 16 of the cylindrical strainer 15 and the sand which is agitated and excavated in the space between the circular bottom plate 17 of the cylindrical strainer 15 and the bottom of the sea flows into the inside of the cylindrical strainer 15 through these apertures 16*a*.

The bottom plate 17 of the cylindrical strainer 15 is provided with a circular opening 18 at the central portion thereof for allowing a rotary shaft 20 of a rotary motor B which is described later to pass there-through in a downward direction.

An impeller 19 is rotatably and concentrically encased in the impeller casing 10. Such impeller 19 is fixedly connected to the rotary shaft 20 of the rotary motor B and rotates along with the rotation of the rotary shaft 20.

A lower threaded portion 21 of the rotary shaft 20 extends downwardly through the suction opening 12 of the impeller casing 10 and the opening 18 of the cylindrical strainer 15 and a rotary head 24 is fixedly secured to the lower end of the lower threaded portion 21 by means of a pair of nuts 22,23.

In this embodiment, such rotary head 24 is shown as an agitator which is used for agitating the sand of the sea bottom disposed below the agitator. In FIG. 2, such agitator comprises an inverted frusto-conical strut portion and a pluralityof agitating blades which are integrally secured to the inclined side wall of the strut portion.

In the above construction, the present invention is virtually characterized by stationarily mounting a flexible-piece-winding preventing sleeve 30 around the head-mounting portion of the rotary shaft 20 which may be made of the pair of nuts 22,23 and the base portion 24a of the rotary head 24.

As shown in FIG. 2, the flexible-piece-winding preventing sleeve 30 is made of a circular sleeve which encases the head-mounting portion with a suitable circumferential gap having the lower end thereof fixedly connected to the inner rim of the bottom plate 17 of the stationary cylindrical strainer 15 and the upper free end thereof extended into the opening formed in the impeller casing 10.

The manner in which the above water pump is operated for excavating the sand is hereinaftr disclosed.

Upon the actuation of the rotary motor B encased in the pump casing A, the rotary shaft 20 is rotated and the impeller 19 and the rotary head 24 which are fixedly secured to the rotary shaft 20 simultaneously rotated.

By the rotation of the rotary shaft 24, the sand or gravels on the bottom of the sea are vigorously agitated and agitated sand enters into the cylindrical strainer 15 along a locus as shown by an arrow A through apertures 16a formed in the annular side wall 16 of the cylindrical strainer 15. Then by the rotation of the impeller 19, the agitated sand is sucked into the impeller casing 10 through the suction opening 12 of the impeller casing 10 as shown by an arrow B and finally discharged outside through the sand discharge pipe which is connected to the discharge opening formed in the circumferential wall of the impeller casing 10.

In the above sand excavating operation, when a flexible piece such as a clothing piece is contained in the agitated flow, such flexible piece tends to adhere or be wound around the mounting portion of the rotary shaft 20 which is rotating or revolving.

In this embodiment, however, since the mounting portion is encased by the flexible-piece-winding preventing sleeve 30, the winding or the adhering of such flexible piece is completely prevented. Namely, since such flexible-piece-winding preventing sleeve 30 is stationarily disposed around the mounting portion of the rotary shaft 20, the flexible piece can make contact with only the outer surface of the stationary flexible-piece-winding preventing sleeve 30 and thereafter such flexible piece flows into the inside of the impeller casing 10 guided by the smooth outer surface of the stationary flexible-piece-winding preventing sleeve 30.

Second Embodiment

Figure 3:
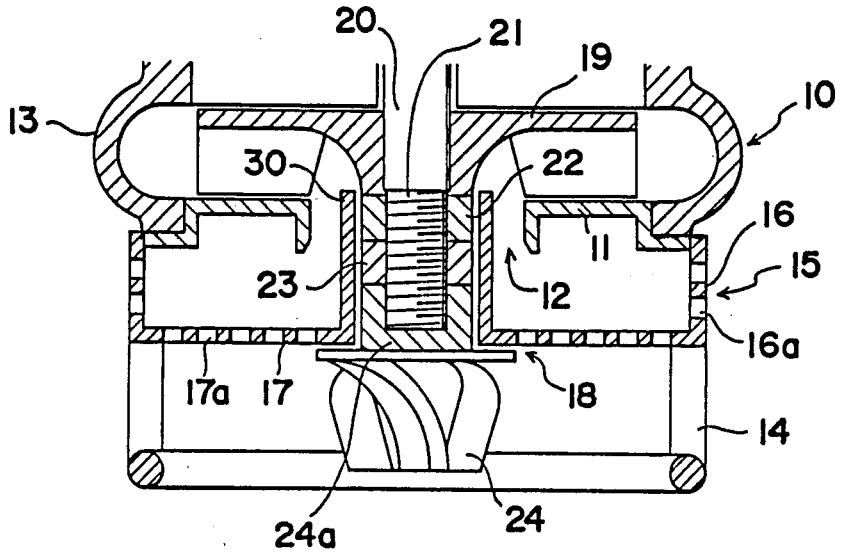
FIG. 3 is an enlarged view of a second embodiment of the above underwater pump.

This embodiment, as can be understood from FIG. 3, is characterized by forming a multiplicity of apertures 17a in the bottom plate 17 of the cylindrical strainer 15 besides the apertures 16a formed in the annular side wall 16 of the cylindrical strainer 15.

The underwater pump of this embodiment is provided with the flexible-piece-winding preventing means 30 of the same construction as in the first embodiment.

Due to such construction, the agitated sand or gravels are carried into the impeller casing 10 by way of the apertures 16a of the annular side wall 16 and the apertures 17a of the bottom plate 17, and during such sand excavating operation, even when the sand includes the flexible piece, the winding of the flexible piece onto the rotating rotary shaft can be effectively prevented in the same manner as described in the first embodiment.

Third embodiment

Figure 4:
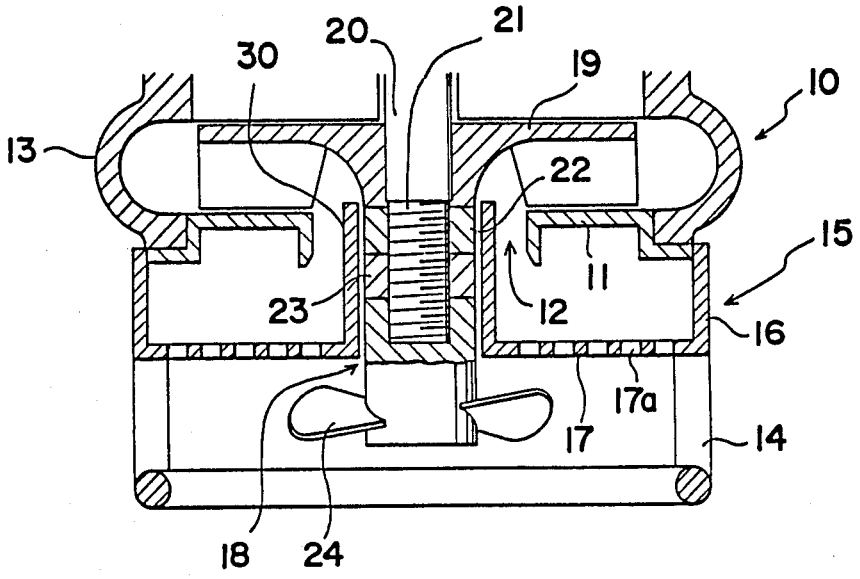
FIG. 4 is an enlarged view of a third embodiment of the above underwater pump.

This embodiment, as can be understood from FIG. 4, is characterized by mounting apertures 17a exclusively on the bottom plate 17 of the cylindrical strainer 15 and the rotary head 24 is constructed as an axial fan which can generate a straight upward flow of sand or gravels.

The underwater pump of this embodiment is provided with the flexible-piece-winding preventing means 30 of the same construction as in the first embodiment.

Due to such construction, the sand or gravels are carried into the impeller casing 10 through the apertures 17a and during such sand excavating operation, even when the sand includes the flexible piece, the winding of the flexible piece onto the rotating rotary shaft 20 can be effectively prevented in the same manner as described in the first embodiment.

Fourth embodiment

Figure 5:
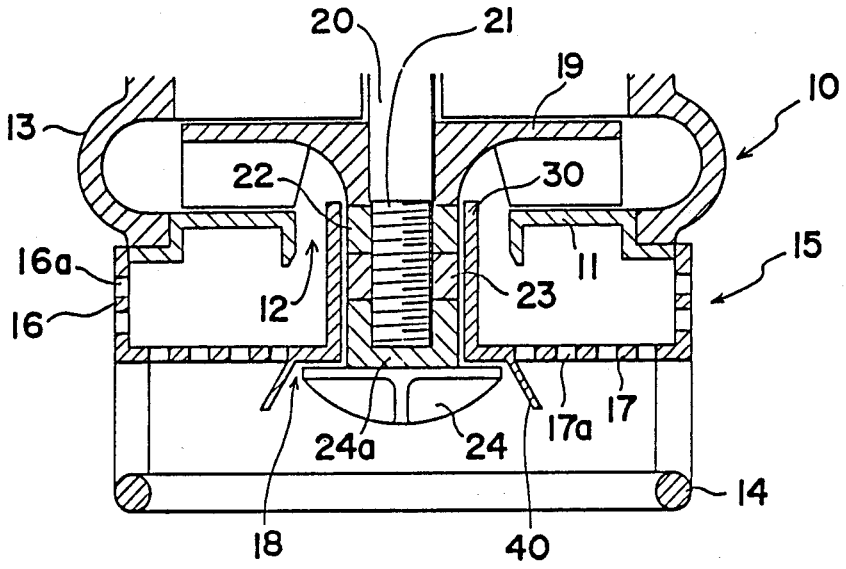
FIG. 5 is an enlarged view of a fourth embodiment of the above underwater pump.

This embodiment, can be understood from FIG. 5, is characterized by disposing an umbrella-shaped member 40 around the rotary head 24 for controlling the agitated flow of water containing sand and gravels and by forming apertures 16a, 17a in the annular side wall 16 and the bottom plate 17 of the cylindrical strainer 15 respectively.

Due to such construction, the sand or gravels are carried into the impeller casing 10 through the apertures 16a and 17a and during such sand excavating operation, even when the sand includes the flexible piece, the winding of the flexible piece onto the rotating rotary shaft 20 can be effectively prevented by the stationary umbrella-shaped member 40.

Fifth embodiment

Figure 6:
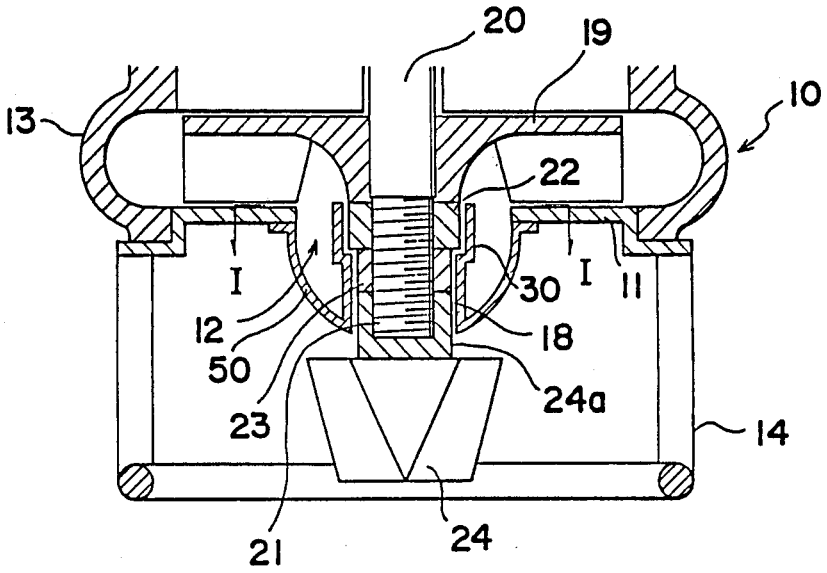
FIG. 6 is an enlarged view of a fifth embodiment of the above underwater pump.
Figure 7:
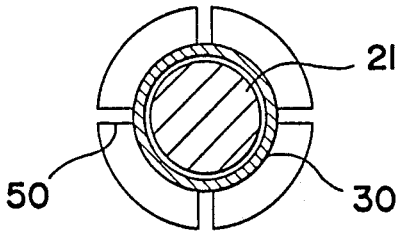
FIG. 7 is a cross-sectional view taken along the line I—I of FIG. 6.

This embodiment, as can be understood from FIG. 6 and FIG. 7, is characterized by forming the cylindrical strainer 15 by a plurality of, for example, four bar-like members 50 which are equidistantly disposed around the rotary shaft 20.

Due to such construction, during such sand excavating operation, even when the sand includes the flexible piece, the winding of the flexible piece onto the rotating rotary shaft 20 can be effectively prevented by the stationary bar-like members 50.

Sixth embodiment

Figure 8:
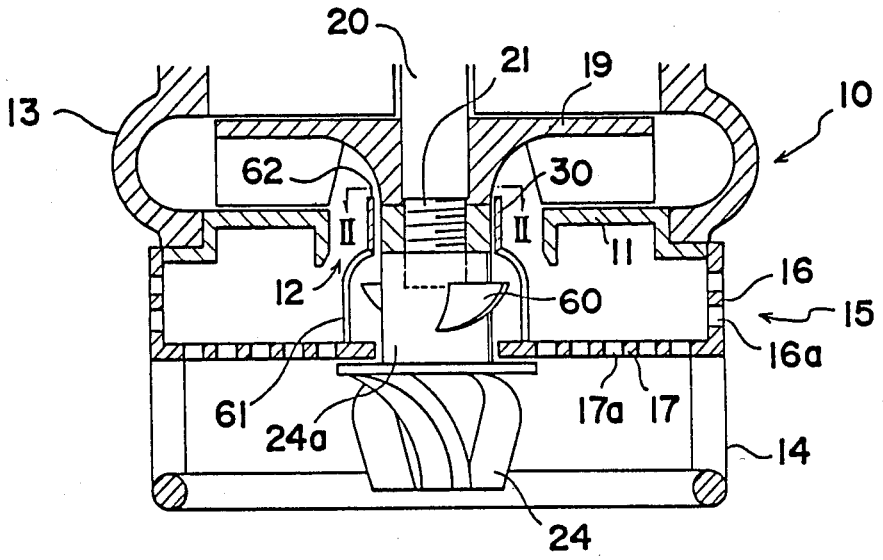
FIG. 8 is an enlarged view of a sixth embodiment of the above underwater pump.
Figure 9:
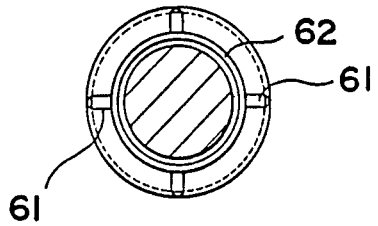
FIG. 9 is a cross-sectional view taken along the line II—II of FIG. 8.

This embodiment, as can be understood from FIG. 8 and FIG. 9, is characterized by mounting an axial fan 60 as well as the rotary head 24 which words as the agitating fan on the lower end of the rotary shaft 20 of the rotary motor B and by encasing the axial fan 60 with a flexible-piece-winding-preventing member which comprises a plurality of circumferentially equidistant bar-like members 61 and an upper connecting ring 62 which connects the upper ends of the bar-like members 61.

Due to such construction, during such sand excavating operation, even when the sand includes the flexible piece, the winding of the flexible piece onto the rotating rotary shaft 20 can be effectively prevented by the stationary bar-like members 61.

Seventh embodiment

Figure 10:
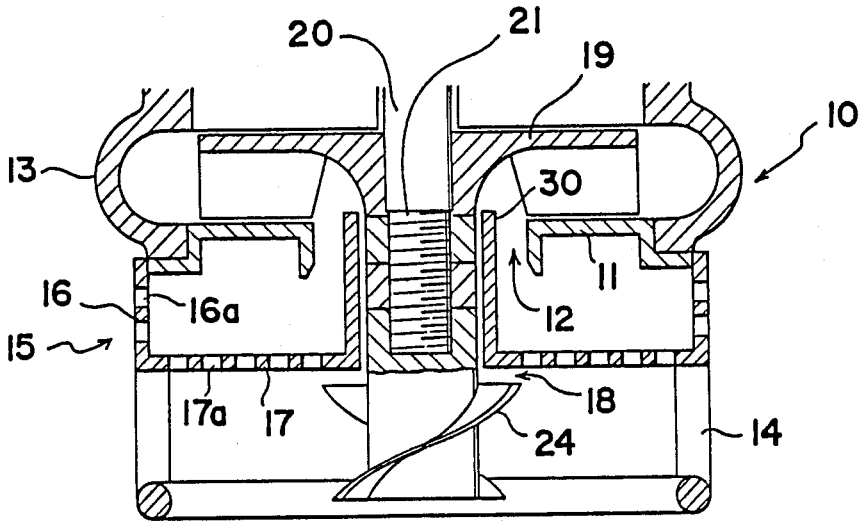
FIG. 10 is an enlarged view of a seventh embodiment of the above underwater pump.

This embodiment, as can be understood from FIG. 10, is characterized by mounting the rotary head 24 which works as a cutter besides the agitating fan on the lower end of the rotary shaft 20 of the motor.

In this embodiment, the flexible-piece-winding-preventing member having the same construction as that of the sixth embodiment is provided.

Due to such construction, during such sand excavating operation, even when the sand includes the flexible piece, the winding of the flexible piece onto the rotating rotary shaft 20 can be effectively prevented by the stationary bar-like members.

Eighth embodiment

Figure 11:
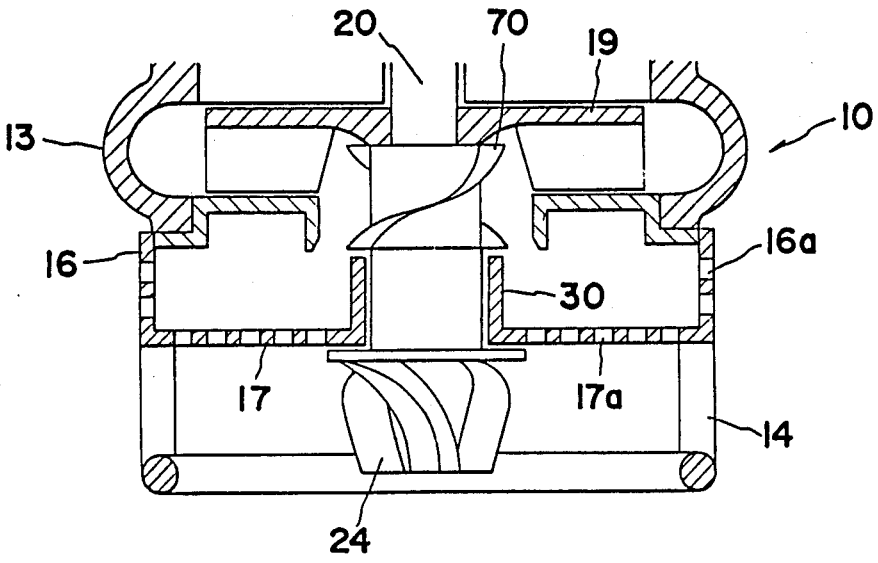
FIG. 11 and FIG. 12 are enlarged cross-sectional view of an eighth embodiment of the present inention.
Figure 12:
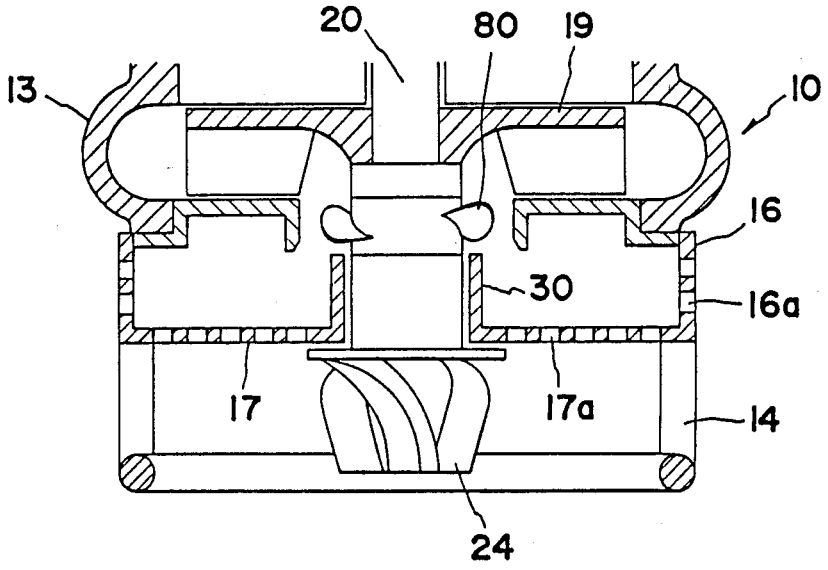

This embodiment, as can be understood from FIG. 11 and FIG. 12, is characterized by disosing a spirally-shaped axial fan 70 or a propeller-shaped fan 80 on the portion of the rotary shaft 20 which is above the flexible-piece-winding-preventing member 30.

Due to such construction, during such sand excavating operation, even when the sand includes the flexible piece, the winding of the flexible piece onto the rotating rotary shaft 20 can be effectively prevented by flexible-piece-winding-preventing member 30.

In the above embodiments (second embodiment to eighth embodiment), since the mounting portion of the rotary head 24 is encased by the flexible-piece-adhering-preventing member 30, even when the rotary head 24 or the rotary shaft 20 is being rotated, the winding or the adhesion of the flexible piece to the mounting portion of the rotating rotary head 24 can be effectively prevented by means of the stationary flexible-piece-winding-preventing member 30.

Furthermore the flexible-piece-adhering-preventing member 30 can protect the double nuts 22,23 which are located at the extremity of the rotary shaft 20 and are exposed outside so that the wear of the double nuts is prevented thus prolonging the life thereof.

In the above embodiments, the impeller casing can be any type including the volute type and the fixing structure, the shape of the rotary head and the number of blades which are attached to the rotary head can be selected as desired.

As has been described above, the present invention has the following advantages:

(a) Since the mounting portion of the rotary head is encased by the flexible-piece-winding-preventing member, the winding or adhesion of a flexible piece to the mounting portion can be effectively prevented; and (b) Any damage or wear caused by sand or gravels onto the mounting portion of the rotary head can be prevented.

I claim:

1. An underwater pump for excavating or sucking sands or gravel from the bottom of a sea or a river comprising a pump casing having a lower end, a motor water-tightly encased in said pump casing, an impeller casing integrally attached to the lower end of said pump casing, a cylindrical strainer disposed below said impeller casing and having a plurality of apertures formed on a wall thereof, a rotary shaft extending downwardly from said motor, a rotory head fixedly secured to the lower end of said rotary shaft, said rotary shaft extending through an inlet opening formed on a bottom plate of said impeller casing and a central opening of said cylindrical strainer, said rotary shaft including a rotary-head mounting portion disposed in a water flow path defined within said cylindrical strainer, and a stationary flexible-piece-winding preventing memoer encasing the rotary head mounting portion of said rotary shaft, said flexible-piece-winding preventing member being made of a circular sleeve having a diameter smaller than a diameter of said rotary head, said circular sleeve having a lower end thereof integrally connected with a circular rim portion of said bottom plate of said cylindrical strainer and an upper end thereof extending into said impeller casing through said inlet opening of said impeller casing wherein a circumferential gap is provided between said circular sleeve and said roatary head mounting portion.

2. An underwater pump according to claim 1, wherein said cylindrical strainer includes means defining a side wall and means defining a bottom wall, and the plurality of apertures are formed in the means defining a side wall.

3. An underwater pump according to claim 2, wherein said stationary flexible-piece-winding preventing member comprises a circular sleeve surrounding said rotary-head mounting portion of said rotary shaft.

4. An underwater pump according to claim 1, wherein said cylindrical strainer includes means defining a side wall and means defining a bottom wall, and the plurality of apertures are formed in the means defining a bottom wall.

5. An underwater pump according to claim 4, wherein said stationary flexible-piece-winding preventing member comprises a circular sleeve surrounding said rotary-head mounting portion of said rotary shaft.

6. An underwater pump according to claim 1, wherein said cylindrical strainer includes means defining a side wall and means defining a bottom wall, and the plurality of apertures are formed in both the means defining the side wall and the means defining the bottom wall.

7. An underwater pump according to claim 6, wherein said stationary flexible-piece-winding preventing member comprises a circular sleeve surrounding said rotary-head mounting portion of said rotary shaft.

8. An underwater pump according to claim 1, wherein said stationary flexible-piece-winding preventing member comprises a circular sleeve surrounding said rotary-head mounting portion of said rotary shaft.

9. An underwater pump according to claim 8, wherein said circular sleeve comprises an upper end and a lower end, said cylindrical strainer includes a bottom wall circumferentially disposed about said rotary-head mounting portion of said rotary shaft, the lower end of said circular sleeve is fixedly secured to the bottom wall of said cylindrical strainer, and the upper end of said circular sleeve extends freely from said cylindrical strainer into said impeller casing.

10. An underwater pump according to claim 9, further including a pair of nuts and a base portion of said rotary head mounted on the rotary-head mounting portion of said rotary shaft.

11. An underwater pump according to claim 1, further including an umbrella-shaped member connected to and below said cylindrical strainer and surrounding said rotary head.

12. An underwater pump according to claim 1, wherein said stationary flexible-piece-winding preventing member comprises a circular sleeve surrounding said rotary-head mounting portion of said rotary shaft and said cylindrical strainer comprises a plurality of bar-like members disposed equidistantly around the circular sleeve.

13. An underwater pump according to claim 1, further including an axial fan mounted on the rotary-head mounting portion of the rotary shaft above the rotary head, wherein said stationary flexible-piece-winding preventing member comprises a plurality of bar-like members disposed equidistantly about said axial fan and an upper connecting ring fixedly securing upper ends of the bar-like members.

* * * * *